US009483981B2

(12) United States Patent
Letourneur et al.

(10) Patent No.: US 9,483,981 B2
(45) Date of Patent: Nov. 1, 2016

(54) DYNAMIC DISPLAY ADJUSTMENT

(75) Inventors: Hervé Jacques Clément Letourneur, San Francisco, CA (US); David J. Foster, Los Altos, CA (US); Laurent E. Sellier, San Francisco, CA (US)

(73) Assignee: Amazon Technologies, Inc., Reno, NV (US)

( * ) Notice: Subject to any disclaimer, the term of this patent is extended or adjusted under 35 U.S.C. 154(b) by 95 days.

(21) Appl. No.: 13/534,950

(22) Filed: Jun. 27, 2012

(65) Prior Publication Data

US 2014/0002428 A1 Jan. 2, 2014

(51) Int. Cl.
*G09G 3/34* (2006.01)

(52) U.S. Cl.
CPC ..... *G09G 3/34* (2013.01); *G09G 2320/0626* (2013.01); *G09G 2330/021* (2013.01); *G09G 2360/144* (2013.01)

(58) Field of Classification Search
CPC ..... G09G 2360/14; G09G 2360/145; G09G 2360/16; G09G 3/30; G09G 5/00; G09G 2310/068; G09G 3/34; G09G 2320/0626; G09G 2330/021; G09G 2360/144
See application file for complete search history.

(56) References Cited

U.S. PATENT DOCUMENTS 5,907,222 A 5/1999 Lengyel et al.
6,215,920 B1 * 4/2001 Whitehead et al. ..... 385/18
7,352,930 B2 4/2008 Lowles
7,859,617 B2 12/2010 Kleverman et al.
8,096,695 B2 1/2012 Ong
2002/0050974 A1 5/2002 Rai et al.
2005/0108642 A1 * 5/2005 Sinclair, II ..... G06F 9/44505 715/700
2005/0151716 A1 7/2005 Lin
2008/0248837 A1 10/2008 Kunkel
2009/0027921 A1 1/2009 Chou et al.
2009/0096745 A1 4/2009 Sprague et al.
2009/0115763 A1 * 5/2009 Inoue ..... 345/211
2010/0149145 A1 6/2010 Van Woudenberg et al.
2011/0001764 A1 * 1/2011 Rhodes ..... 345/690
2011/0050719 A1 * 3/2011 Diefenbaugh et al. ..... 345/589
2011/0074803 A1 * 3/2011 Kerofsky ..... 345/589
2011/0157108 A1 * 6/2011 Ishii ..... 345/204
2011/0199671 A1 * 8/2011 Amundson et al. ..... 359/296
2011/0205397 A1 * 8/2011 Hahn et al. ..... 348/231.6
2012/0019152 A1 * 1/2012 Barnhoefer et al. ..... 315/158
2012/0019492 A1 * 1/2012 Barnhoefer et al. ..... 345/207
2012/0046947 A1 * 2/2012 Fleizach ..... 704/260
2012/0127198 A1 * 5/2012 Gundavarapu ..... G09G 5/024 345/629
2012/0182276 A1 * 7/2012 Kee ..... 345/207
2013/0048837 A1 2/2013 Pope et al.
2013/0161489 A1 6/2013 Gardner

OTHER PUBLICATIONS

International Search Report and Written Opinion for International Application No. PCT/US13/47092 mailed Oct. 31, 2013 (9 pgs.).

* cited by examiner

*Primary Examiner* — Claire X Pappas
*Assistant Examiner* — Richard Hong
(74) *Attorney, Agent, or Firm* — Sutherland Asbill & Brennan LLP

(57) ABSTRACT

Devices such as electronic book readers, televisions, and so forth use displays to present information to users. Described herein are devices and methods for dynamically adjusting illumination, waveforms used to generate the image, presentation of the information, or a combination thereof based on one or more of ambient light level, display illumination level, and so forth.

21 Claims, 12 Drawing Sheets

DYNAMIC DISPLAY ADJUSTMENT

BACKGROUND

A variety of devices, such as electronic book ("e-Book") reader devices, desktop computers, portable computers, smartphones, tablet computers, game consoles, televisions, and so forth provide visual information to users. This visual information may comprise content such as television, movies, e-books, and so forth.

Figure 1:
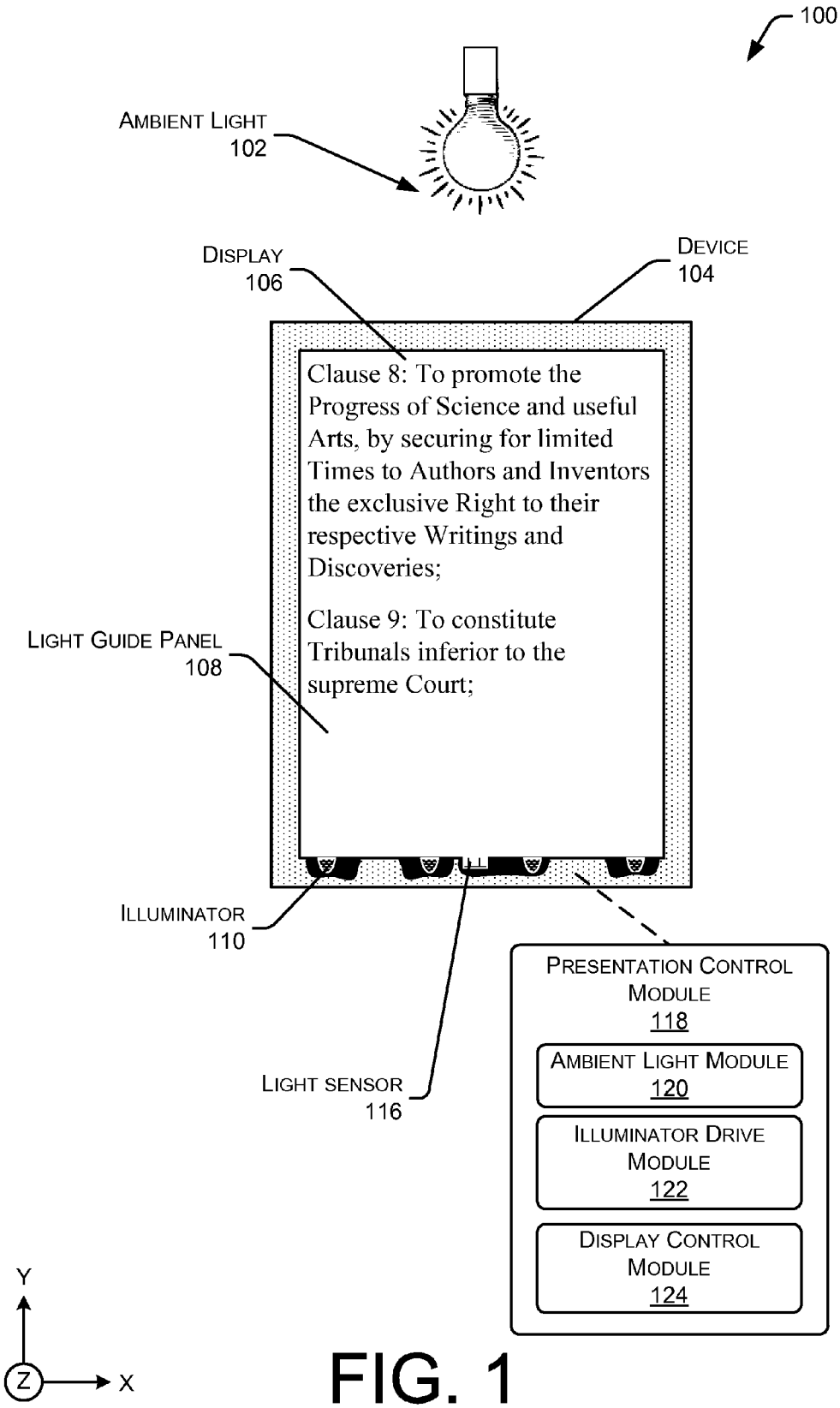
FIG. 1 illustrates an environment with a device comprising a display, one or more illuminators, a light sensor, and a presentation control module configured to provide dynamic display adjustment.

Certain implementations will now be described more fully below with reference to the accompanying drawings, in which various implementations and/or aspects are shown. However, various aspects may be implemented in many different forms and should not be construed as limited to the implementations set forth herein. Like numbers refer to like elements throughout. For clarity of illustration, the figures in this disclosure are not depicted to scale. For ease of description, three mutually orthogonal axes may be shown, designated as X, Y, and Z.

DETAILED DESCRIPTION

A variety of devices, such as electronic book ("e-Book") reader devices, desktop computers, portable computers, smartphones, tablet computers, televisions, and so forth are used to access various forms of content and other information. These devices may incorporate displays which are emissive, reflective, or a combination thereof. An emissive display emits light to form an image. Emissive displays include, but are not limited to, backlit liquid crystal displays, plasma displays, cathode ray tubes, light-emitting diodes, image projectors, and so forth. Reflective displays use incident light to form an image. This incident light may be provided by the sun, general illumination in the room, a reading light, a front light with one or more illuminators, and so forth. Reflective displays include, but are not limited to, electrophoretic displays, interferometric displays, electrowetting displays, cholesteric displays, and so forth.

During usage, lighting conditions associated with the device may change. The lighting conditions comprise the ambient light from the environment in which the device resides, illumination provided by the device such as one or more illuminators coupled to a light guide panel to illuminate the reflective display, or both.

Described in this disclosure are devices and methods for dynamically adjusting, based at least in part on the lighting conditions, illumination provided by one or more illuminators, the presentation of text on the display, and the waveforms used to generate images on the display. These adjustments may occur individually or in combination with one another. Dynamic adjustment provides several benefits including improving readability on the device, reducing power consumption, and so forth.

A reflective display during operation reflects a given amount of impinging ambient light. Higher reflectivity values may result in improved user experience, such as improving the legibility of text presented on the reflective display. Reflectivity indicates a relative percentage or portion of light incident on the display which is reflected. As described herein, additional illumination from one or more illuminators may be provided to increase an effective reflectivity of the display.

As the lighting conditions change, the presentation of text on the display may be modified. As described herein, one or more text presentation attributes may be modified to improve the user experience. For example, in bright sunlight, a weight of fonts used to present text on the display may be increased to minimize the effects of washout and improve legibility.

Depending upon the type of display, effects from redrawing the display may become apparent as lighting conditions change. For example, an electrophoretic display comprising electrophoretic material may experience different levels of ghosting depending upon the waveform used to generate the image. A fast waveform may quickly draw the information on the electrophoretic display, but under medium to bright light, a "ghost" or residual image of the previous image may remain visible. In comparison, a slow waveform which occurs over a longer duration allows more time for the electrophoretic particles to move and, as a result, allows formation of a higher fidelity, which experiences no ghosting even when inspected under bright light. Described herein are techniques for selecting a waveform for drawing images on the display which are based at least in part on the lighting conditions.

Illustrative Devices

FIG. 1 illustrates an environment 100 with a device configured to provide dynamic display adjustment. The environment 100 may include ambient light 102 and a device 104. The device 104 may comprise an electronic book ("e-Book") reader device, a computer display, a portable computer, a smartphone, a tablet computer, a game console, a television, an in-vehicle display, and so forth.

The ambient light 102, when present, may be provided by artificial lighting such as a light bulb, by natural lighting such as the sun, or a combination. The ambient light 102 may be provided by a point source such as the sun or other highly localized source, or a diffuse source such as a cloudy sky.

The ambient light 102 may impinge on at least a portion of the device 104. The device 104 may comprise one or more displays which may be configured to present visual information to a user. The one or more displays may be emissive or reflective. An emissive display emits light to form an image. Emissive displays include, but are not limited to, backlit liquid crystal displays, plasma displays, cathode ray tubes, light-emitting diodes, image projectors, and so forth. Reflective displays use incident light to form an image. This incident light may be provided by the sun, general illumination in the room, a reading light, a frontlight, and so forth. Reflective displays include electro-optical displays such as electrophoretic displays, cholesteric displays, electrowetting displays, and so forth, as well as interferometric displays and other displays. For example, the electrophoretic displays may comprise an electrophoretic material configured such that when electricity is applied an image may be formed. The display may be configured to present images in monochrome, color, or both. In some implementations, the display may use emissive, reflective, or combination displays with emissive and reflective elements.

In the implementation shown here, the display comprises a display 106. This display 106 may comprise a reflective display such as an electrophoretic display ("EPD"), or in some implementations, may comprise an emissive display. For ease of discussion, and not by way of limitation, in this disclosure, "front" indicates a side which may be proximate to a user during typical use of the device 104, while the "back" indicates a side opposite the front which is distal to the user during typical use, along the Z axis depicted here.

Arranged in front of the display 106 is a light guide panel 108. The light guide panel 108 is substantially planar and may comprise one or more materials such as plastic, glass, aerogel, metal, ceramic, and so forth. The light guide panel 108 may be configured with one or more features on the surface thereof, or embedded within, which are configured to direct light along pre-determined paths. These features may be diffractive, refractive, reflective, and so forth. In some implementations where the display 106 comprises a reflective display, the light guide panel 108 may be configured to distribute at least a portion of the light emitted from one or more illuminators 110 to a front side of the display 106. The light guide panel 108 may be laminated to the display 106. In some implementations, the illuminators 110 may be configured to provide backlighting to the display 106. The illuminators 110 are shown here in a cutaway view of the interior of the chassis 114 to provide front lighting to the display 106.

The one or more illuminators 110 are configured to emit light when activated. Each illuminator 110 may comprise one or more light-emitting diodes ("LEDs"), electroluminescent materials, sonoluminescent materials, fluorescent lights, incandescent lights, or a combination thereof. In some implementations, different types of illuminators 110 may be used in the same device 104. For example, electroluminescent lights may be used in conjunction with LEDs. The one or more illuminators 110 may be arranged along one or more edges of a perimeter 112 of the light guide panel 108. The one or more illuminators 110 are adjacent to and may be optically coupled to the light guide panel 108 such that light emitted from the one or more illuminators 110 is distributed to at least a portion of the display 106.

The optical coupling between the light guide panel 108 and the one or more illuminators 110 may comprise one or more of physical proximity, an air gap, an adhesive, a mechanical interface, and so forth. In some implementations, one or more surface features may be provided on the light guide panel 108, the illuminator 110, or both. These surface features, such as diffusers, grooves, grating, dimples, lenses, planar surfaces, concave surfaces, convex surfaces, and so forth, may be used to enhance or attenuate the transmission of light between the one or more illuminators 110 and the light guide panel 108. In some implementations, these surface features may be separate or discrete elements which have been coupled to the light guide panel 108. For example, a microlens array may be adhered to the light guide panel 108 to aid the optical coupling with an illuminator 110.

The one or more illuminators 110 and other components such as one or more light sensors 116 may be arranged within a chassis 114 or exterior case. Shown here are one or more light sensors 116. The one or more light sensors 116 may be provided with an aperture through the chassis 114 through which at least a portion of the ambient light 102 may enter for sensing. In another implementation, the one or more light sensors 116 may be coupled to the light guide panel 108.

The one or more light sensors 116 are configured to detect a flux of incident photons, such as those directed by the light guide panel 108, and provide a signal indicative of that flux. The light sensor 116 may comprise a photocell, a phototransistor, a photoresistor, photodiodes, a reverse-biased LED, and so forth. In some implementations, at least a portion of the one or more illuminators 110 may be used as a light sensor. For example, where the illuminator 110 comprises an LED, it may be reverse-biased to generate a signal indicative of incident photons. The light sensor 116 may comprise an analog, digital, or mixed analog-digital device. The one or more light sensors 116 may be configured to detect one or more of visible light, infrared light, or ultraviolet light. In some implementations, different types of light sensors 116 may be used on the same device 104. For example, one light sensor 116 sensitive to near infrared light may be used as well as another light sensor 116 sensitive to visible light.

A presentation control module 118 may be coupled to the one or more illuminators 110 and the one or more light sensors 116. The presentation control module 118 may comprise an ambient light module 120, an illuminator drive module 122, and a display control module 124. The ambient light module 120 may be configured to receive one or more signals from the one or more light sensors 116 and determine an ambient light level. In another implementation, the ambient light module 120 may be configured to receive user input indicative of the ambient light level. For example, the user may be presented with a user interface allowing for selection of ambient light levels from options such as "night," "indoors," "sunlight" and so forth.

The illuminator drive module 122 may be configured to drive the one or more illuminators 110, such as activating to emit light when in an active state or deactivating to cease emitting light when in an inactive state. The illuminator drive module 122 may be configured to provide variable illumination intensity with the one or more illuminators 110. This variation in illumination may be provided to improve user experience, to reduce power consumption, and so forth. In some implementations, such as where the one or more illuminators 110 comprise LEDs, the illuminator drive module 122 may be configured to drive the LEDs with a pulse-width modulated signal.

The display control module 124 may be coupled to the display 106 and may be configured to operate the display 106 such that images are formed. The display control module 124 may be configured to present text with different text presentation attributes, drive the display 106 with different waveforms, and so forth.

The presentation control module 118 may be configured to adjust illumination to provide a pre-determined reflectivity, modify one or more of the text presentation attributes, or select a particular waveform. The lighting conditions may be determined by using data from the ambient light module 120 and the illuminator drive module 122. The processes associated with operation of the presentation control module 118 are discussed below.

In some implementations, the ambient light module 120 may be configured to determine characteristics about the ambient light, such as color temperature. For example, the ambient light module 120 may receive data from the one or more light sensors 116 and determine a source of ambient illumination such as sunlight, fluorescent bulbs, incandescent bulbs, LEDs, and so forth. This determination may then be used to dynamically adjust the illumination by the one or more illuminators 110, modify text presentation, select waveforms, and so forth. The determination of the source of ambient illumination may be provided to a display control module 124 to allow for adjustment of a presented image in response thereto. For example, under a source of ambient light, which has a higher color temperature and thus appears bluer, the colors on a color display may be adjusted to maintain a desired output. Likewise, the illuminator drive module 122 may be configured to modify the light emitted by the one or more illuminators 110 to compensate at least in part for the ambient light.

The modules described herein may comprise analog, digital, or mixed analog and digital circuitry. In one implementation, one or more processors may be used to provide the functions described herein.

Figure 2:
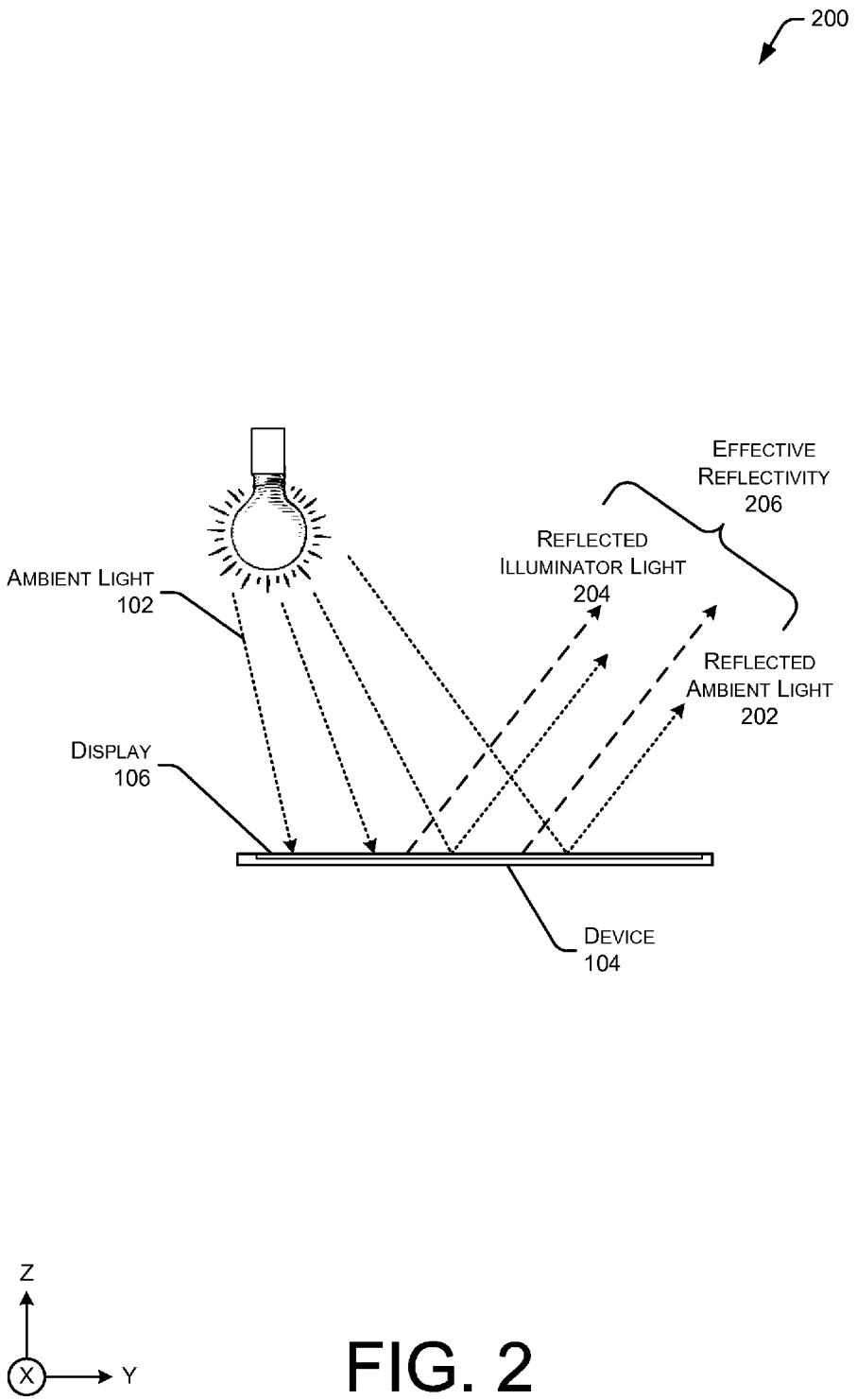
FIG. 2 illustrates the reflectivity of a reflective display as illuminated by ambient light and the one or more illuminators.

FIG. 2 illustrates the reflectivity 200 of a reflective display 106 as illuminated by ambient light and one or more illuminators. Reflective displays may present images by selectively reflecting at least a portion of incident light. The incident light comprises the ambient light 102, light emitted from the one or more illuminators 110, or both. For ease of illustration in this disclosure, the ambient light 102 which reflects from the display 106 is reflected ambient light 202, while light emitted from the one or more illuminators 110 and reflected from the display is reflected illuminator light 204. The combined flux of the reflected ambient light 202 and the reflected illuminator light 204 is an effective reflectivity 206 as perceived by a user. In some implementations, as an alternative to determining the effective reflectivity 206, an effective light flux from the panel may be used. This effective light flux comprises the sum of the reflected ambient light 202 and the reflected illuminator light 204. The reflected illuminator light 204 may thus be used to recoup reflectivity losses in the display 106.

White areas on the reflective display 106 reflect a substantial portion of the incident light while dark areas absorb or scatter a substantial portion of the incident light. By varying the degree of reflectance, different shades may be provided. However, even when configured to present a white area, the reflective display may not be totally reflective.

A typical piece of copier paper may exhibit a reflectivity of about 70%. Text printed thereon in black is highly legible and generally considered comfortable to read. In comparison, the reflected ambient light 202 of the electrophoretic display may be about 30%.

The presentation control module 118 may be configured to activate the one or more illuminators to provide illumination to the reflective display. This additional light flux results in the reflected illuminator light 204, which when integrated by the user's eye in combination with the reflected ambient light 202, makes the reflective display 106 appear to be more reflective. This increase in effective reflectivity 206 may improve the legibility of the information presented on the display 106.

The presentation control module 118 may be configured to determine an effective reflectivity 206 of the display 106 based on one or more of the ambient light level as determined by the one or more light sensors 116, information presented on the display 106, environmental factors, and so forth. A pre-determined threshold of effective reflectivity 206 may be set, and the level of illumination provided by the one or more illuminators 110 may be varied to maintain that effective reflectivity 206.

Figure 3:
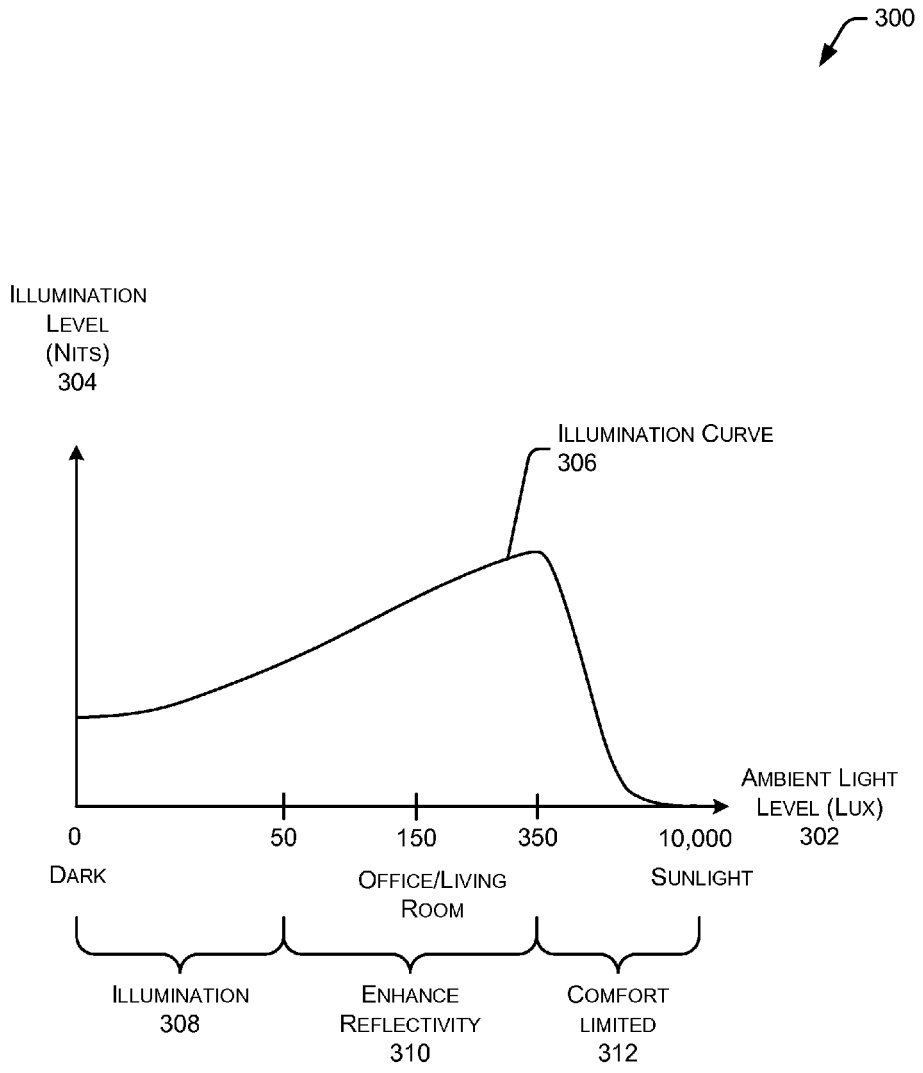
FIG. 3 is a graph depicting changing illumination levels to enhance the reflectivity of a reflective display.

FIG. 3 is a graph 300 depicting changing illumination levels to enhance the reflectivity of the reflective display 106. A horizontal axis indicates an ambient light level 302. In this illustration, the ambient light level ranges from 0 lux of complete darkness to over 10,000 lux in sunlight. A vertical axis indicates an illumination level 304 such as provided by the one or more illuminators 110 via the light guide panel 108 of the reflective display 106.

The presentation control module 118 may be configured to provide the non-linear illumination curve 306 depicted here. The shape of this curve is illustrative, and in other implementations, other curves may be utilized.

For ease of illustration, the illumination curve 306 is depicted as having three operating regions: an illumination region 308, an enhance reflectivity region 310, and a comfort limited region 312. The illumination region 308 extends from about 0 to 50 lux. Within this region, the one or more illuminators 110 provide illumination to allow for presentation of the information on the display 106. Minimal or no ambient light 102 is available, so the information is primarily or entirely presented to the user via the reflected illuminator light 204. The illumination level 304 may be kept relatively low to avoid dazzling the user in the dark lighting conditions.

The enhance reflectivity region 310 extends from about 50 lux to 350 lux. This may be the lighting conditions experienced ranging from a dim hallway to a brightly lit office. The enhance reflectivity region 310 is where the presentation control module 118 applies additional illumination to maintain the desired effective reflectivity 206. In the enhance reflectivity region 310, without the illumination, the information presented on the display 106 is visible and legible to the user. However, the effective reflectivity 206 may be below the pre-determined threshold of reflectivity. As illustrated here, as the ambient light level 302 increases, the illumination level 304 increases to maintain the pre-determined effective reflectivity 206.

The comfort limited region 312 extends from about 350 lux and up. Within this range, the increasing ambient light level 302 may render the display 106 uncomfortable to view, because it is too bright. Within the comfort limited region 312, the presentation control module 118 decreases the illumination level 304.

Figure 4:
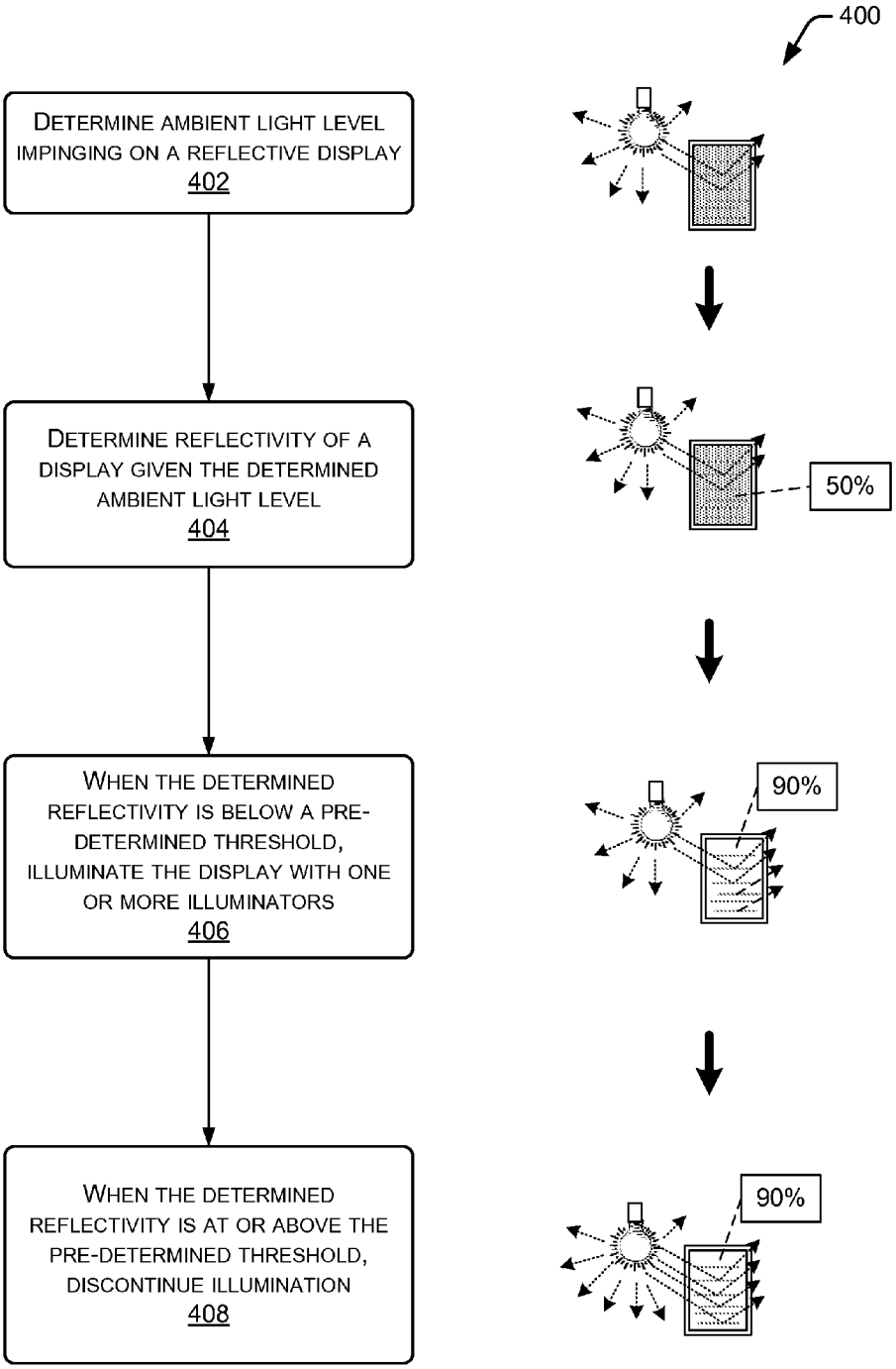
FIG. 4 illustrates a flow diagram of a process of maintaining a pre-determined effective reflectivity by controlling the illumination level of the one or more illuminators.

FIG. 4 illustrates a flow diagram of a process 400 of maintaining a pre-determined effective reflectivity by controlling the illumination level of the one or more illuminators. In some implementations, the presentation control module 118 may provide this functionality.

Block 402 determines an ambient light level. The ambient light module 120 may determine the ambient light level based at least in part on the one or more light sensors 116. In some implementations, the ambient light level may be determined based on time of day, position, temperature, or other environmental conditions. The ambient light level may comprise the ambient light 102 impinging on at least a portion of the reflective display.

Block 404 determines the reflectivity of the reflective display 106 based at least in part on the ambient light level. In some implementations, this determination may comprise retrieving a value from a lookup table based at least in part on the ambient light level. In some implementations, this determination may be made based at least in part on the image presented on the display 106. For example, when the image on the display comprises the words "The End" in the middle of the display in black on a white background, the reflectivity may differ from when the words are displayed as white on a black background. In another implementation the determination may be based at least in part on user input indicative of the level of illumination. For example, the user may select a "sunlight" mode.

When the determined reflectivity is below a pre-determined threshold, block 406 illuminates the reflective display 106 with the one or more illuminators 110. The one or more illuminators 110 may be coupled to the light guide panel 108 to provide a front light. As described above, the reflected ambient light 202 sums with the reflected illuminator light 204 resulting in the effective reflectivity 206. As a result, the user perceives the display 106 as being more reflective. In some implementations, intensity of the one or more illuminators 110 may be based at least in part on the determined reflectivity. For example, as the determined reflectivity increases, the intensity of illumination may be decreased.

When the determined reflectivity is at or above the pre-determined threshold, block 408 deactivates the one or more illuminators 110. For example, when the ambient light level 302 as described above with regard to FIG. 3 enters the comfort limited region 312, the illumination provided by the one or more illuminators 110 may decrease and then cease.

Figure 5:
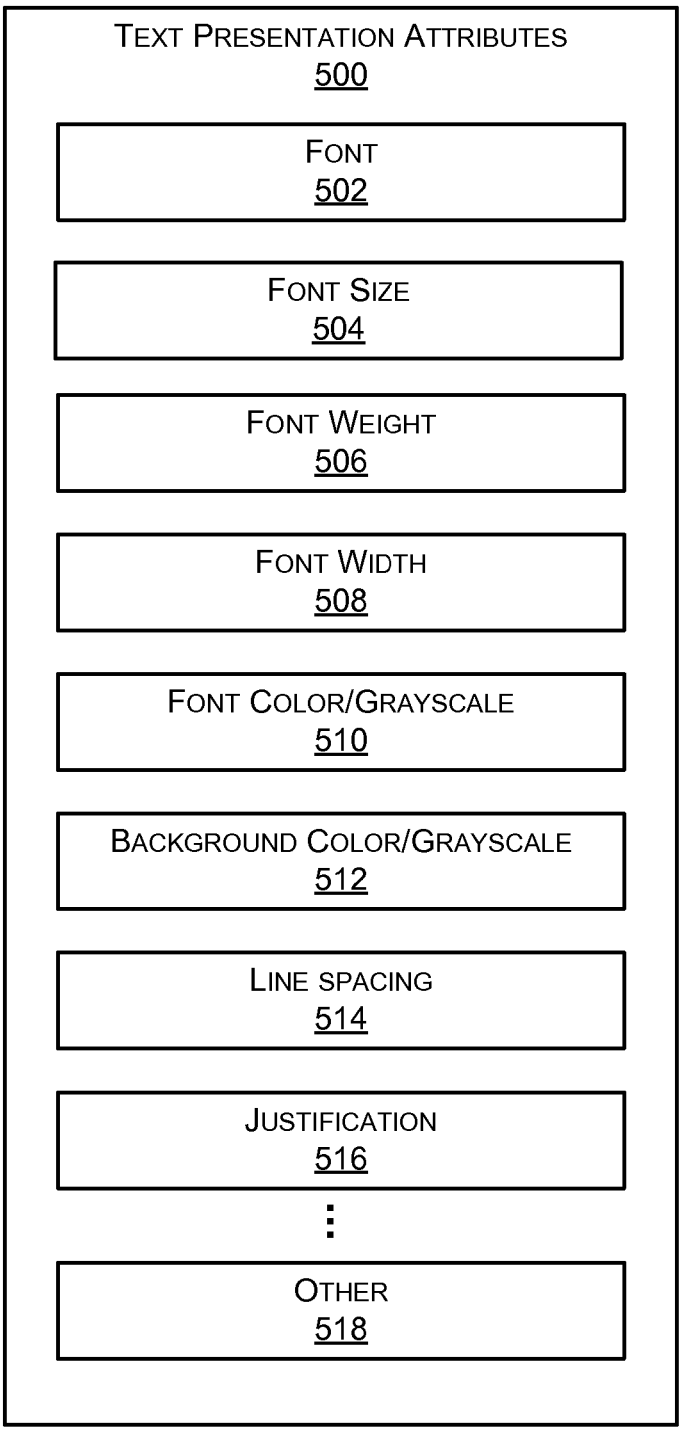
FIG. 5 illustrates text presentation attributes which may be dynamically adjusted based at least in part on lighting conditions.

In addition to, or instead of, maintaining the effective reflectivity 206 of the display 106, one or more text presentation attributes may be dynamically adjusted based at least in part on lighting conditions. The text presentation attributes may be dynamically adjusted for emissive, reflective, or combination emissive and reflective displays. As described above, the lighting conditions comprise the ambient light 102, illumination from the one or more illuminators 110, or both. FIG. 5 illustrates text presentation attributes 500.

The text presentation attributes 500 of text presented on the display 106 may be modified based at least in part on one or more of the ambient light level, level of illumination provided by the one or more illuminators 110, and so forth. These modifications may be provided to improve legibility, reduce apparent washout of the image on the display 106 under bright lighting conditions, and so forth.

The text presentation attributes 500 may include a font 502, and the modification may comprise changing from a first font to a second font. For example, the font may be changed from a serif font in low light to a sans serif font in bright light.

Font size 504, font weight 506, and font width 408 may be modified. The font weight 506 may be described as thickness of character outlines of the glyphs relative to their height. For example, in bright light, the font weight 506 may be increased resulting in darker text presented on the display 106.

The text presentation attributes 500 may also include a font color/grayscale 510 and a background color/grayscale 512. For example, based at least in part on the lighting conditions, the font color 510 of gray text may be rendered as black to improve visibility in bright lighting conditions. Likewise, the background color 512 may be modified, such as from white to light gray to reduce dazzling the user in bright sunlight.

Line spacing 514, justification 516, and other paragraph formatting may be modified based at least in part on the lighting conditions. Other 518 text presentation attributes may also be modified such as spacing between glyphs and so forth.

In addition to text presentation attributes 500, other presentation attributes for non-textual data may be modified based at least in part on one or more of the ambient light level, the level of illumination provided by the one or more illuminators 110, and so forth. For example, under bright lighting conditions, line weights in line drawings may be increased.

Figure 6:
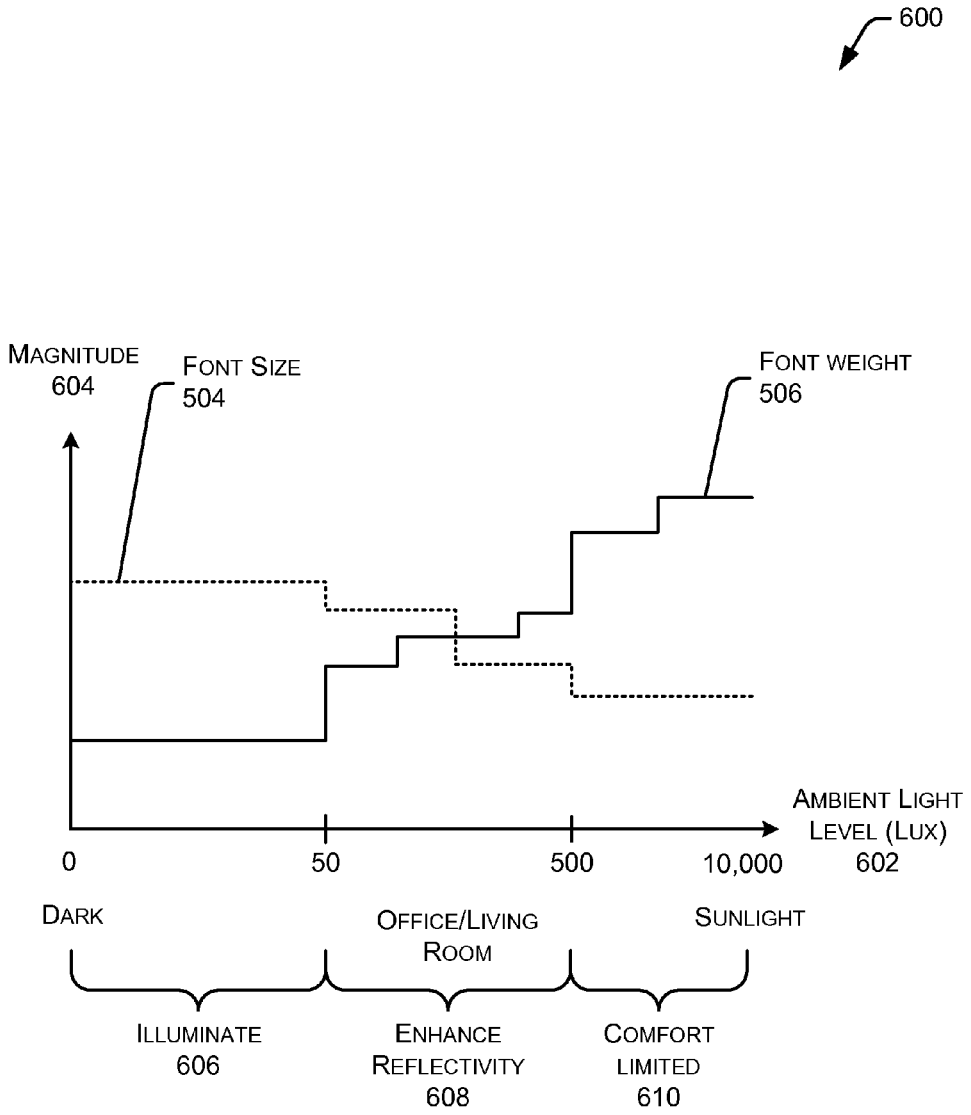
FIG. 6 is a graph depicting changing text presentation attributes according to the lighting conditions.

FIG. 6 is a graph 600 depicting changing text presentation attributes according to the lighting conditions. A horizontal axis indicates an ambient light level 602. In this illustration, the ambient light level 602 ranges from 0 lux of complete darkness to over 10,000 lux in sunlight. A vertical axis indicates magnitude 604 of the text presentation attributes shown here. The presentation control module 118 may be configured to modify the text presentation attributes 500 based at least in part on the lighting conditions. This illustration depicts modification to the font size 504 and the font weight 506, although one or more of the text presentation attributes 500 may be varied.

As this graph shows, in the interval designated illuminate 606, when the ambient light level 602 is between 0 and about 50 lux, the font size 504 is relatively large and the font weight 506 is relatively low. As the illumination increases, to encompass the interval of enhance reflectivity 608, the font size 504 decreases in a step fashion, while the font weight 506 increases in a step fashion. As shown here, for the interval designated as comfort limited 610, in bright light and sunlight, the font weight 506 has been increased while the font size 504 has been decreased.

Figure 7:
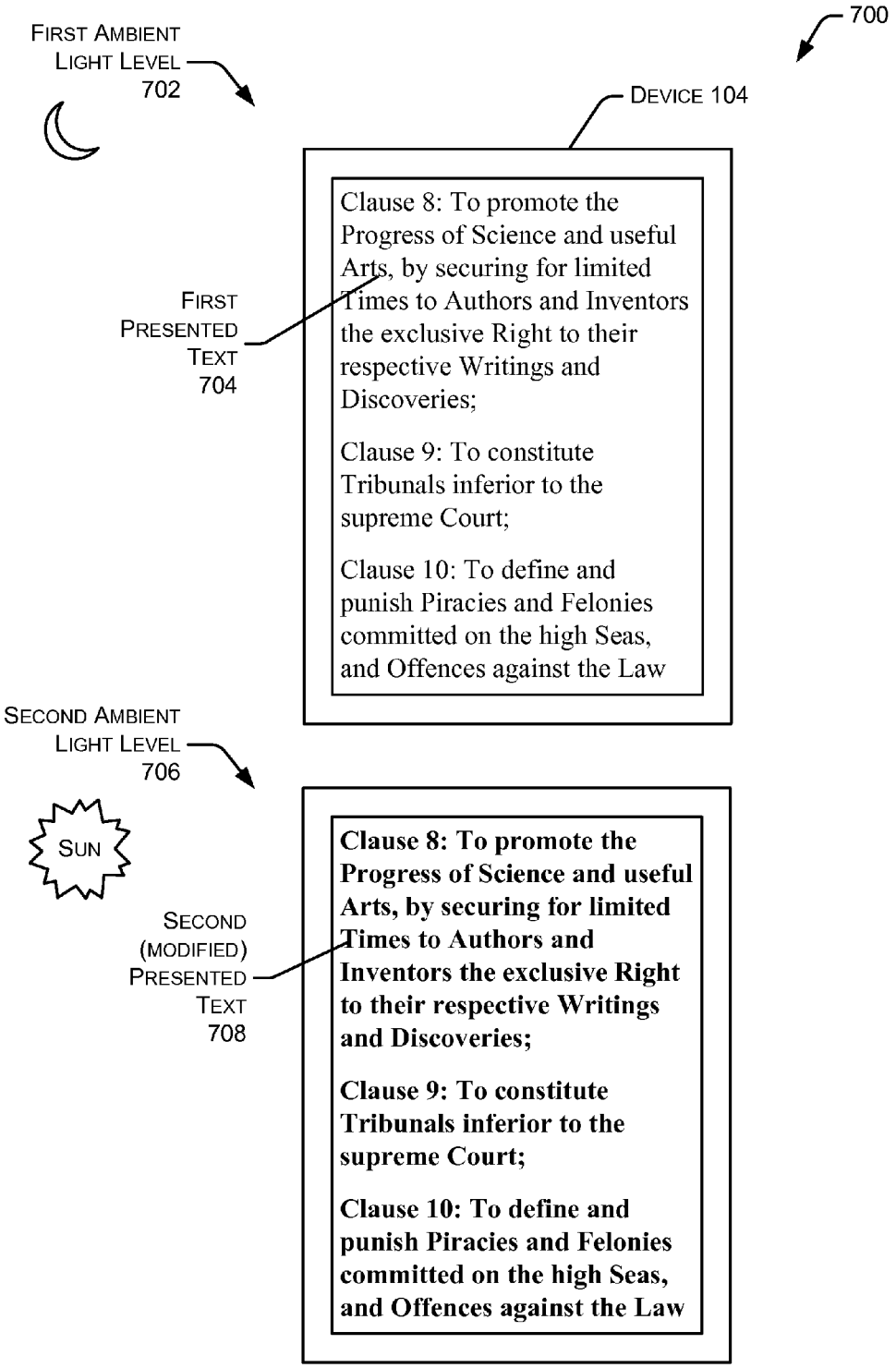
FIG. 7 illustrates a user interface of the device and changes in the text presentation based at least in part on the lighting conditions.

FIG. 7 illustrates a user interface 700 of the device 104 and changes in the text presentation based at least in part on the lighting conditions. The lighting conditions may be determined based at least in part upon user input, data from the light sensor 116, and so forth. For example, where the device omits the light sensor 116, the user may manually input information about the lighting conditions.

In this illustration, a first ambient light level 702 is low, such as in the evening. While the lighting conditions are dim, the presentation control module 118 provides first presented text 704. In comparison, a second ambient light level 706 is high, such as in the sunlight. Based at least in part on the change in the lighting conditions, the presentation control module 118 provides a second (modified) presented text 708. The text presentation attributes 500 of the second (modified) presented text 708 have been modified relative to the first presented text 704. In this example, font weight 506 of the text has been increased.

Figure 8:
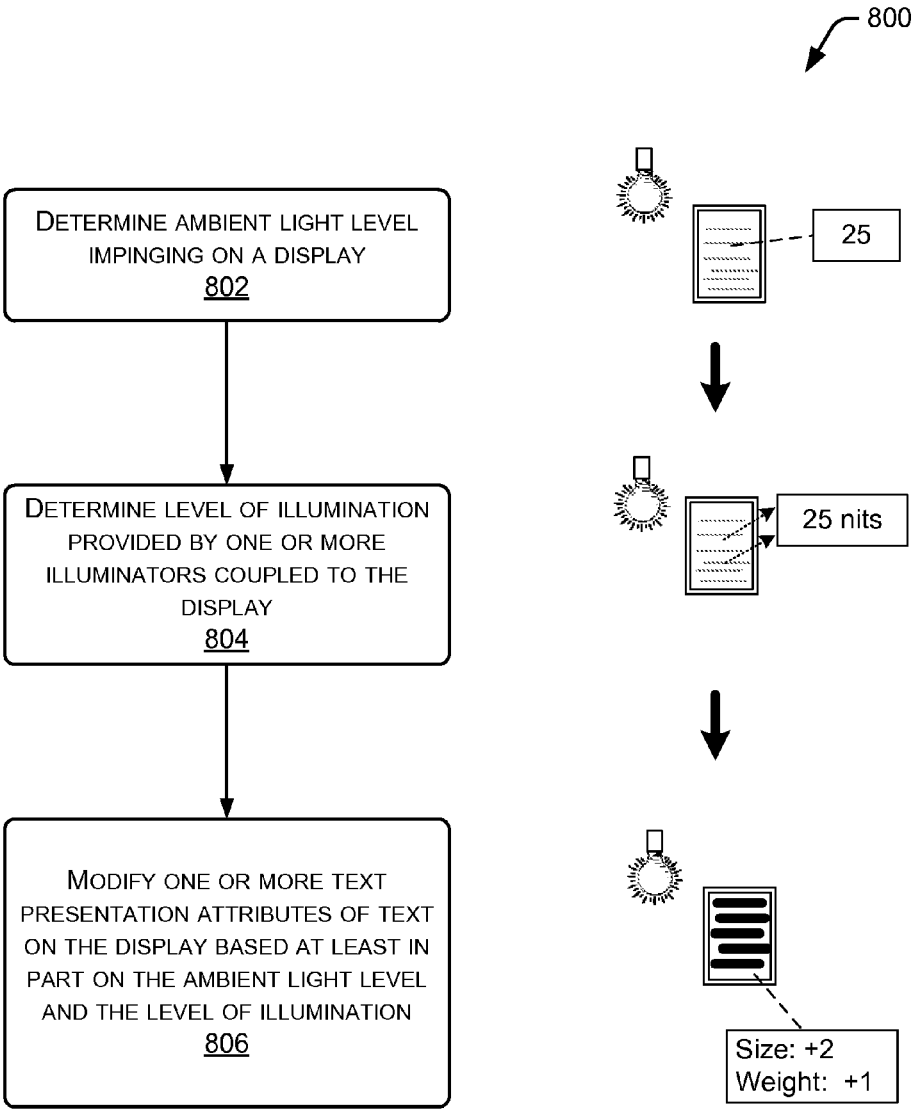
FIG. 8 illustrates a flow diagram of a process of modifying the text presentation attributes based at least in part on the lighting conditions.

FIG. 8 illustrates a flow diagram of a process 800 of modifying the text presentation attributes 500 based at least in part on the lighting conditions. In some implementations, the presentation control module 118 may provide this functionality.

Block 802 determines an ambient light level. The ambient light module 120 may determine the ambient light level based at least in part on the one or more light sensors 116. For example, the ambient light level may be 25 lux. In some implementations, the ambient light level may be determined based on time of day, position, temperature, or other environmental conditions. The ambient light level may comprise the ambient light 102 impinging on at least a portion of the display 106. The display 106 may comprise a reflective display, an emissive display, or a combination reflective and emissive display.

Block 804 determines a level of illumination provided by the one or more illuminators 110 coupled to the display 106. For example, the illuminator drive module 122 may be interrogated to request the level at which the illuminators 110 are being driven to indicate that the display 106 is illuminated at a level of 25 nits.

Block 806 modifies one or more of the text presentation attributes 500 configuring presentation of text on the display 106 based at least in part on one or more of the ambient light level, or a level of illumination provided by the one or more illuminators 110. For example, the font size 504 may be increased by two increments (such as points) while the font weight 506 may be increased by one increment (such as from "book" to "plain").

In addition to, or instead of, maintaining the effective reflectivity 206 of the display 106 or modifying one or more text presentation attributes 500, waveforms used to drive a reflective display 106 may be selected based at least in part on lighting conditions as described next.

Figure 9:
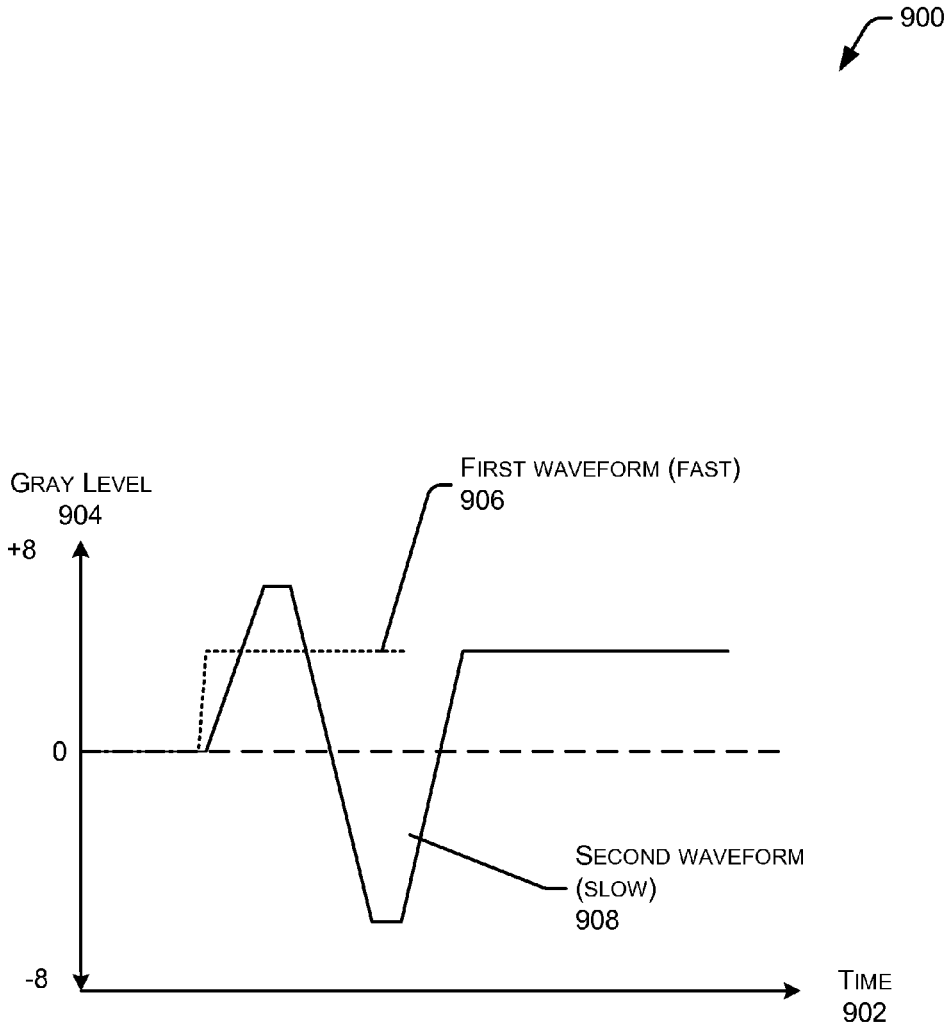
FIG. 9 illustrates a first waveform and a second waveform which may be applied to an electrophoretic display to generate at least a portion of an image.

FIG. 9 illustrates waveforms 900 which may be applied to an electrophoretic display to generate at least a portion of an image. Electrophoretic displays, and other types of reflective displays, may generate an image by applying an electric signal having a particular waveform to the display 106. The waveform is configured to produce movement of one or more electrophoretic particles in the display 106 to form the image. These waveforms may occur over a given period of time. Some waveforms may be completed faster than others. With regard to electrophoretic displays, slower or longer duration waveforms result in higher fidelity images, because, at least in part, the electrophoretic materials have additional time to move within the display and form the image. In comparison, faster or shorter duration waveforms result in lower fidelity images, and the aftereffects, such as a residual or "ghost" image, may remain.

In some implementations, fast and slow waveforms may occur over the same or similar periods of time, but may drive the materials in the display 106 differently. For example, a fast waveform may drive a portion of the display directly to a final particular gray level while a slow waveform may "flash" the display by driving the portion to several different gray levels before achieving the final particular gray level.

In this graph, a horizontal axis indicates time 902 while a vertical axis indicates gray levels 904. A first waveform 906 is indicated with a dotted line while a second waveform 908 is indicated with a solid line. In this illustration, the first waveform 906 is shorter in duration or "faster" than the second waveform 908. The first waveform 906 shows a rapid transition to a particular gray level. In comparison, the second waveform 908 shows a transition between different gray levels, such as occurs when "flashing" the display.

A particular waveform may be selected by the display control module 124 based on one or more factors including, but not limited to, desired responsiveness of the display, ambient temperature, power consumption, or lighting conditions.

Figure 10:
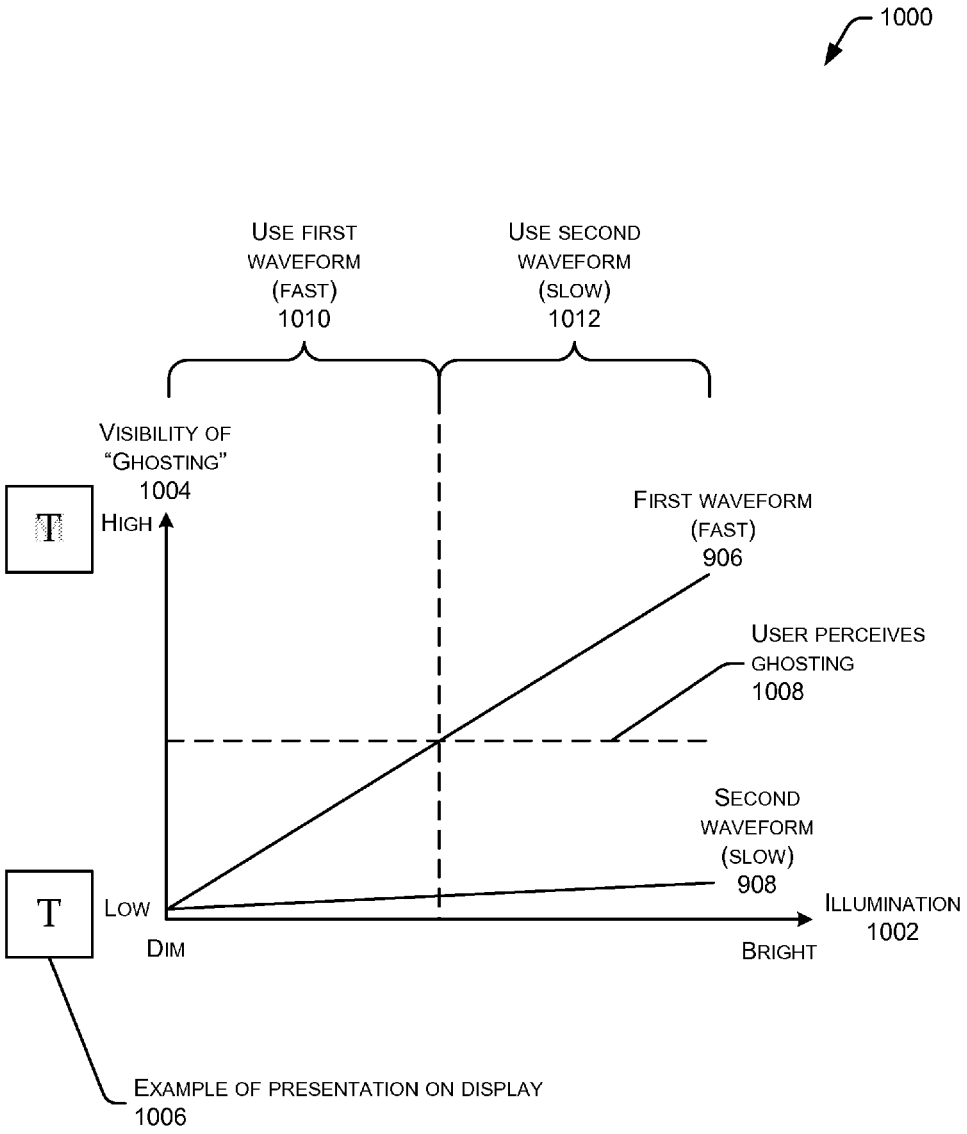
FIG. 10 is a graph depicting the apparent visibility of image "ghosting" during redraws of the electrophoretic display with different waveforms under different lighting conditions.

FIG. 10 is a graph 1000 depicting the apparent visibility of image "ghosting" during redraws of the electrophoretic display with different waveforms under different lighting conditions. In this illustration, a horizontal axis indicates overall illumination 1002 on the display 106 ranging from dim to bright. This may be ambient light 102, light provided by the one or more illuminators 110, or a combination of both. A vertical axis 1004 indicates visibility of "ghosting" or a residual image, ranging from low or no visibility to high visibility. This difference in visibility is illustrated in the examples of presentation on the display 1006. The first waveform (fast) 906 is depicted, illustrating that as the illumination increases, the visibility of ghosting also increases significantly. The actual incident of a residual may not necessarily increase. However, due to the increasing illumination, existing residual images become more apparent.

In comparison, the second waveform (slow) 908 has a significantly smaller slope compared to the first waveform 906. Even in bright illumination 1002, ghosting is either very low or non-existent. Depicted here a threshold at which a user perceives ghosting 1008. At this point, the user may see undesirable ghosting. When the illumination 1002 is below this threshold, the presentation control module 118 may be configured to select the first waveform 1010 to draw an image on the display. When the illumination 1002 is above this threshold, the presentation control module 118 may be configured to select the second waveform 1012 to draw an image on the display. However, as mentioned above, the second waveform 908 may have a longer duration than the first waveform 906, resulting in more time to redraw the image on the display 106. As a result, the redraw may be more noticeable to the user and thus less desirable.

Figure 11:
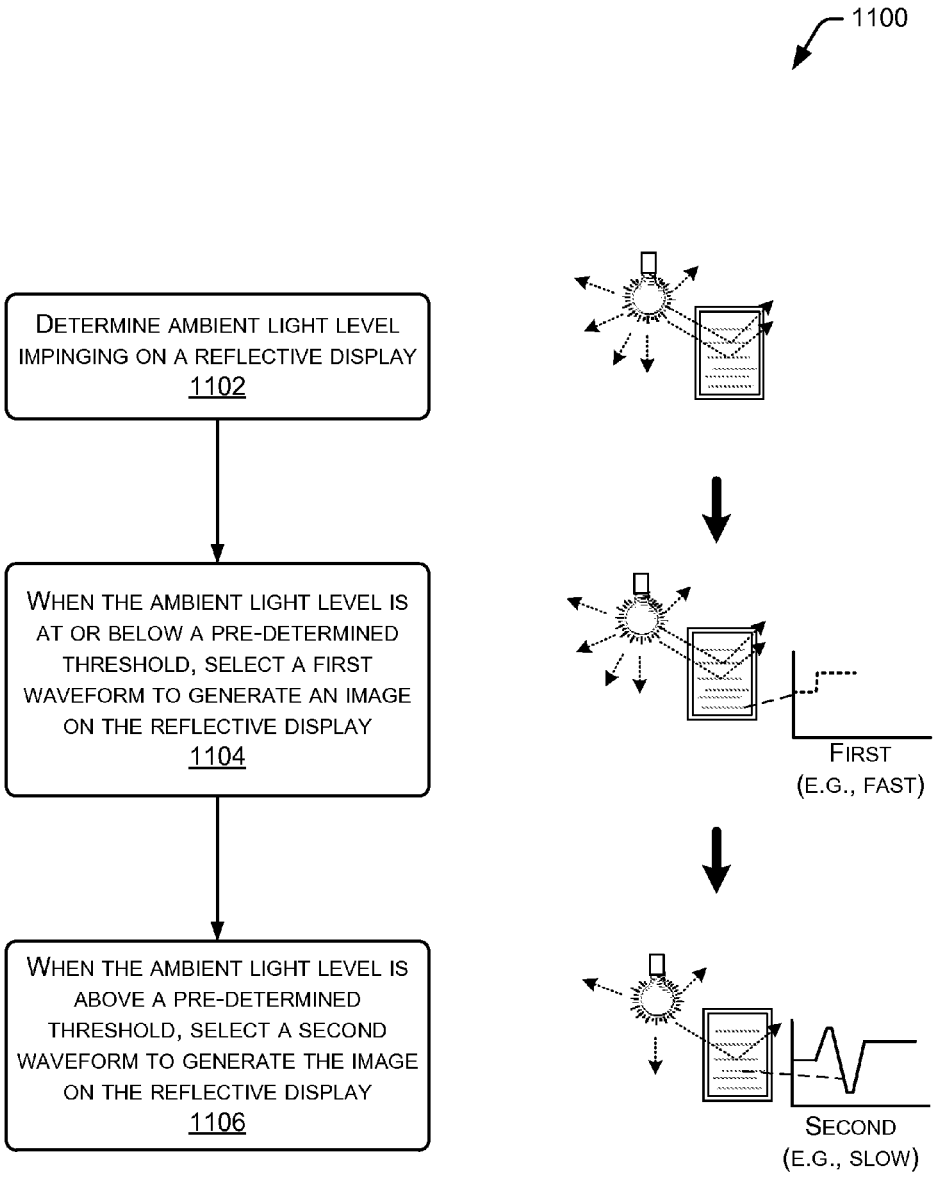
FIG. 11 illustrates a flow diagram of a process of selecting a waveform based at least in part on the lighting conditions.

FIG. 11 illustrates a flow diagram of a process 1100 of selecting a waveform based at least in part on the lighting conditions. As described above, under different lighting conditions, ghosting may be more apparent to the user. However, to maintain a specified level of interactivity or for other reasons, the display 106 may be configured to redraw as quickly as possible. Thus, the presentation control module 118 may be configured to select between a plurality of waveforms based at least in part on the lighting conditions.

Block 1102 determines an ambient light level impinging on at least a portion of the reflective display 106. The ambient light module 120 may determine the ambient light level based at least in part on the one or more light sensors 116. In another implementation, the illumination level of the one or more illuminators 110 may be used instead of, or in addition to, the ambient light level. In some implementations, the ambient light level may be determined based on time of day, position, temperature, or other environmental conditions.

When the ambient light level is at or below a predetermined threshold, block 1104 selects the first waveform (fast) 906 to generate an image on the reflective display 106. As described above with regard to FIG. 10, under these lighting conditions, any ghosting is minimally visible.

When the ambient light level is above a pre-determined threshold, block 1106 selects the second waveform (slow) 908 to generate the image on the reflective display 106. As described above with regard to FIG. 10, under these lighting conditions, any ghosting is more visible, and thus a higher fidelity image is called for, as generated by the second waveform (slow) 908.

Figure 12:
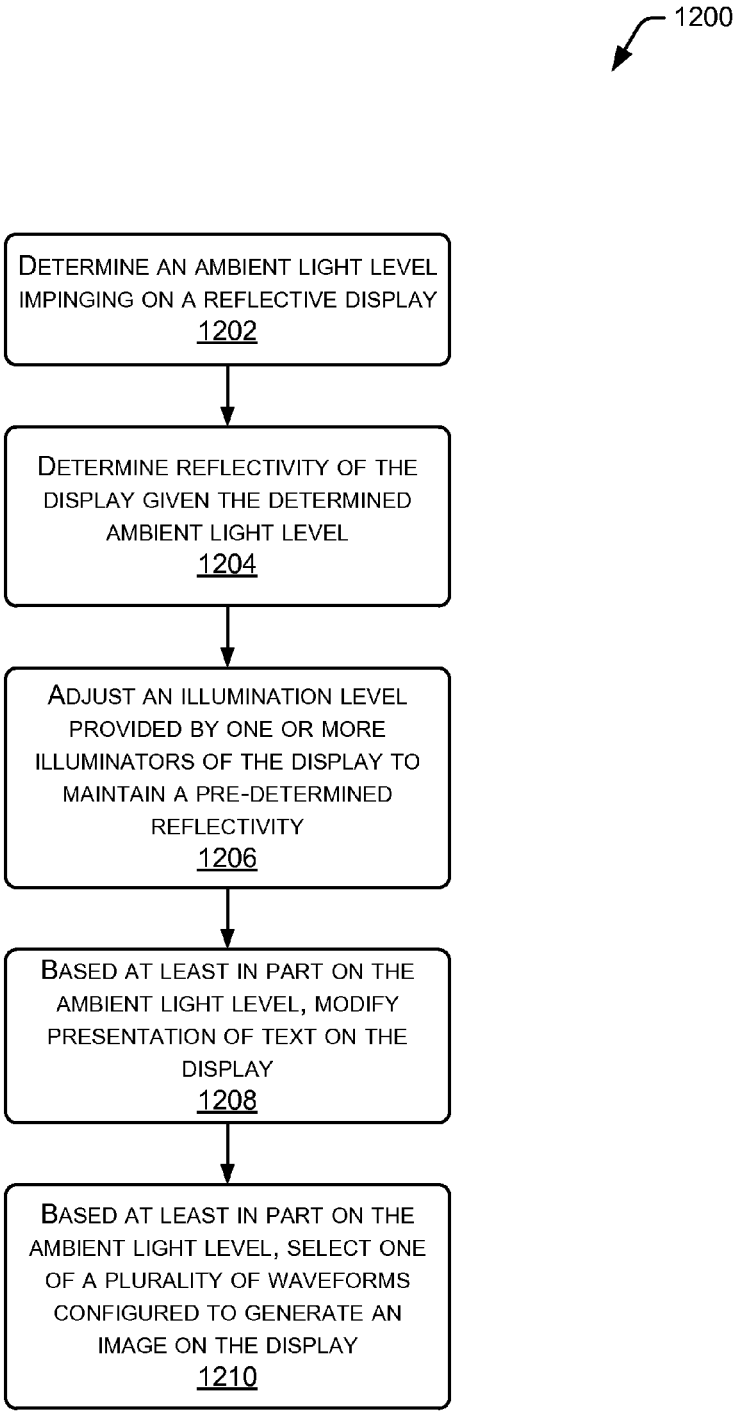
FIG. 12 illustrates a flow diagram of a process of selecting a waveform, maintaining a pre-determined reflectivity, and modifying the presentation of text based at least in part on lighting conditions.

FIG. 12 illustrates a flow diagram of a process 1200 of selecting a waveform, maintaining a pre-determined reflectivity, and modifying the presentation of text based at least in part on lighting conditions. As described above, this process may be implemented by the presentation control module 118.

Block 1202 determines an ambient light level impinging on the reflective display 106. For example, the light sensors 116 may measure the light impinging on at least a portion of the electrophoretic display.

Block 1204 determines the reflectivity of the display given the determined ambient light level. In some implementations, this determination may comprise retrieving a value from a lookup table based at least in part on one or more of the illumination level, the ambient light level, and so forth. Block 1206 adjusts the illumination level provided by one or more illuminators 110 of the display 106 to maintain a pre-determined reflectivity. For example, some illumination may be provided to increase the effective reflectivity 206.

Block 1208, based at least in part on one or more of the ambient light level or the illumination level provided by the one or more illuminators, modifies presentation of text on the display. For example, the font weight 506 may be increased.

Block 1210, based at least in part on one or more of the ambient light level, illumination level provided by the one or more illuminators, or effective reflectivity, selects one of a plurality of waveforms configured to generate an image on the display 106. In some implementations, the waveform may be selected based at least in part on the modification of the text presentation attributes 500.

CONCLUSION

The processes described and shown above may be carried out or performed in any suitable order as desired in various implementations. Additionally, in certain implementations, at least a portion of the processes may be carried out in parallel. Furthermore, in certain implementations, less than or more than the processes described may be performed.

Certain aspects of the disclosure are described above with reference to flow diagrams of methods, apparatuses, or computer program products according to various implementations. It will be understood that one or more blocks of the flow diagrams, and combinations of blocks in the flow diagrams, can be implemented by computer-executable program instructions. Likewise, some blocks of the flow diagrams may not necessarily need to be performed in the order presented, or may not necessarily need to be performed at all, according to some implementations.

These computer-executable program instructions may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the flow diagrams support combinations of means for performing the specified functions, combinations of elements or steps for performing the specified functions and program instruction means for performing the specified functions. It will also be understood that each block of the flow diagrams, and combinations of blocks in the flow diagrams, can be implemented by special-purpose, hardware-based computer systems that perform the specified functions, elements or steps, or combinations of special-purpose hardware and computer instructions.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims.

What is claimed is:

1. A device, comprising:

a reflective display comprising a front side;

a light guide panel coupled to the front side of the reflective display and configured to distribute at least a portion of light from one or more illuminators to the front side;

the one or more illuminators coupled to the light guide panel such that light emitted by the one or more illuminators is distributed at least in part to the front side;

one or more light sensors disposed adjacent to at least one of the one or more illuminators and configured to measure an ambient light level proximal to the one or more light sensors; and a presentation control module coupled to the reflective display, the one or more illuminators, and the one or more light sensors, wherein the presentation control module is configured to:

determine, via the one or more light sensors, the ambient light level based at least in part on the measured ambient light level from the one or more light sensors;

determine a reflectivity of the reflective display based at least in part on the ambient light level and a level of illumination based on the light emitted by the one or more illuminators;

when the determined reflectivity is below a threshold, illuminate the reflective display, at least in part, using the one or more illuminators to reach a pre-determined level of reflectivity;

when the determined reflectivity is at or above the threshold, deactivate the one or more illuminators to reach the pre-determined level of reflectivity; and modify a font weight of text and a font size of text presented on the reflective display by increasing the font weight of the text by a first incremental amount while decreasing a font size of the text by a second incremental amount, wherein the modification is based at least in part on one or more of the ambient light level or a level of illumination provided by the one or more illuminators.

2. The device of claim 1, wherein intensity of the one or more illuminators is based at least in part on the determined reflectivity.

3. The device of claim 1, wherein the determined reflectivity comprises a sum of ambient light reflected by the reflective display and at least a portion of emitted light from the one or more illuminators when active.

4. The device of claim 1, wherein the determined reflectivity is further based at least in part on an image presented on the reflective display.

5. The device of claim 1, the presentation control module further configured to:

when the ambient light level is at or below a predetermined threshold, select a first waveform to generate an image on the reflective display; and when the ambient light level is above a pre-determined threshold, select a second waveform to generate the image on the reflective display.

6. The device of claim 5, wherein the first waveform and the second waveform are configured to produce movement of one or more electrophoretic particles in the reflective display.

7. The device of claim 5, wherein the first waveform completes in less time than the second waveform.

8. The device of claim 1, wherein the first incremental amount is different than the second incremental amount.

9. A device, comprising:

a display;

one or more illuminators configured to illuminate the display;

one or more light sensors configured to measure an ambient light level, wherein the one or more light sensors are disposed adjacent to at least one of the one or more illuminators and configured to measure an ambient light level proximal to the one or more light sensors, wherein the ambient light includes a portion of light generated by the one or more illuminators and light from an environment surrounding the one or more light sensors; and a presentation control module coupled to the display, the one or more illuminators, and the one or more light sensors, wherein the presentation control module is configured to:

determine an effective reflectivity based at least in part on the ambient light level measured by the one or more light sensors and a level of illumination based on the light emitted by the one or more illuminators; and modify a font weight of text and a font size of text on the display by increasing the font weight of the text by a first incremental amount while decreasing a font size of the text by a second incremental amount in response to determining the effective reflectivity.

10. The device of claim 9, wherein the display comprises an electrophoretic display, a cholesteric display, an interferometric display, or an electrowetting display.

11. The device of claim 9, wherein the display comprises an electrophoretic display and the presentation control module is further configured to select a waveform for generating an image on the electrophoretic display from a plurality of waveforms, the selection based at least in part on the ambient light level.

12. The device of claim 11, further comprising a light guide panel coupled to the electrophoretic display and the one or more illuminators optically such that light emitted from the one or more illuminators is distributed to at least a portion of the electrophoretic display.

13. The device of claim 9, wherein the presentation control module is further configured to adjust a level of illumination provided by the one or more illuminators to maintain a predetermined reflectivity.

14. The device of claim 9, wherein the first incremental amount is different than the second incremental amount.

15. A device, comprising:

an electrophoretic display;

one or more light sensors configured to measure an ambient light level, the one or more light sensors configured to measure an ambient light level proximal to the one or more light sensors, wherein the ambient light includes a portion of light generated by the one or more illuminators and light from an environment surrounding the one or more light sensors;

one or more illuminators configured to illuminate the display, wherein the one or more light sensors are disposed adjacent to at least one of the one or more illuminators;

a presentation control module coupled to the electrophoretic display and the one or more illuminators, wherein the presentation control module is configured to:

determine an effective reflectivity based at least in part on the ambient light level measured by the one or more light sensors and a level of illumination based on the light emitted by the one or more illuminators; and select, from a plurality of waveforms, a waveform for generating an image on the electrophoretic display in response to determining the effective reflectivity; and modify a font weight of text and a font size of text presented on the electrophoretic display by increasing the font weight of the text by a first incremental amount while decreasing a font size of the text by a second incremental amount based at least in part on one or more of the ambient light level or the level of illumination provided by the one or more illuminators.

16. The device of claim 15, wherein the waveform is configured to produce movement of one or more electrophoretic particles in the electrophoretic display.

17. The device of claim 15, further comprising one or more light sensors configured to measure an ambient light level, and wherein the presentation control module is further configured to adjust the level of illumination to maintain a pre-determined reflectivity on the electrophoretic display based at least in part on the ambient light level.

18. The device of claim 17, wherein the selection of the waveform is further based at least in part on the ambient light level.

19. The device of claim 15, further comprising one or more light sensors configured to measure an ambient light level, and wherein selection of the waveform is further based at least in part on the ambient light level.

20. The device of claim 19, wherein the plurality of waveforms are configured with differing durations and the selection comprises selecting a relatively short duration waveform when the level of illumination is low and selecting a relatively long duration waveform when the level of illumination is high.

21. The device of claim 19, wherein the presentation control module is further configured to:

adjust the level of illumination to maintain a pre-determined reflectivity on the electrophoretic display based at least in part on one or more of the level of illumination provided by the one or more illuminators, or the ambient light level.

* * * * *